US010264364B2

(12) United States Patent
Yun et al.

(10) Patent No.: US 10,264,364 B2
(45) Date of Patent: Apr. 16, 2019

(54) SIGNAL COMPENSATION METHOD AND APPARATUS

(71) Applicant: Samsung Electronics Co., Ltd., Suwon-si, Gyeonggi-do (KR)

(72) Inventors: Yongsang Yun, Suwon-si (KR); Ohyong Kwon, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 295 days.

(21) Appl. No.: 14/730,772

(22) Filed: Jun. 4, 2015

(65) Prior Publication Data

US 2015/0358747 A1 Dec. 10, 2015

(30) Foreign Application Priority Data

Jun. 9, 2014 (KR) ..... 10-2014-0069649

(51) Int. Cl.
*H04R 25/00* (2006.01)

(52) U.S. Cl.
CPC ..... *H04R 25/453* (2013.01); *H04R 25/50* (2013.01); *H04R 2225/43* (2013.01)

(58) Field of Classification Search
CPC ... H04R 25/453; H04R 25/50; H04R 2225/43
USPC ..... 381/317, 312
See application file for complete search history.

(56) References Cited

U.S. PATENT DOCUMENTS

| | | | | |
|---|---|---|---|---|
| 6,978,155 | B2 | 12/2005 | Berg | |
| 7,570,974 | B2 | 8/2009 | Kaltenbach et al. | |
| 8,280,086 | B2 | 10/2012 | Topholm | |
| 2005/0283263 | A1 | 12/2005 | Eaton et al. | |
| 2008/0044036 | A1* | 2/2008 | Konchitsky | H04R 3/00 381/71.1 |
| 2010/0119093 | A1* | 5/2010 | Uzuanis | H04R 25/70 381/312 |
| 2010/0260341 | A1* | 10/2010 | Sander | H04R 1/1041 381/1 |
| 2011/0176697 | A1* | 7/2011 | Apfel | H04R 25/305 381/314 |
| 2012/0183165 | A1* | 7/2012 | Foo | H04R 25/50 381/314 |
| 2012/0215519 | A1* | 8/2012 | Park | G06F 17/289 704/2 |

FOREIGN PATENT DOCUMENTS

JP 4516147 B2 8/2010

* cited by examiner

*Primary Examiner* — Yogeshkumar Patel
(74) *Attorney, Agent, or Firm* — Jefferson IP Law, LLP

(57) ABSTRACT

A signal compensation method and an electronic device adapted to the method are provided. The signal compensation method includes storing filter data related to a hearing aid in a storage unit, recording a first sound signal, and compensating for the first sound signal, based on the filter data.

13 Claims, 13 Drawing Sheets

<610>

SIGNAL COMPENSATION METHOD AND APPARATUS

CROSS-REFERENCE TO RELATED APPLICATION(S)

This application claims the benefit under 35 U.S.C. § 119(a) of a Korean patent application filed on Jun. 9, 2014 in the Korean Intellectual Property Office and assigned Serial number 10-2014-0069649, the entire disclosure of which is hereby incorporated by reference.

TECHNICAL FIELD

The present disclosure relates to a method and apparatus for compensating for a signal.

BACKGROUND

With the development of medical technology, the average life expectancy of human beings is increasing and thus the population of elderly people is rapidly increasing. As people are getting older, their body functions are deteriorating. A variety of devices are needed to supplement the elderly people's bodily functions. One of the devices is a hearing aid. Hearing aids are electronic devices that supplement an ability to hear.

Hearing aids are designed to include a small sized semiconductor chip that amplifies sound for the wearer. Hearing aids amplify input signals over the frequency band according to the degree of impaired hearing. Considering the functionality and psychological comfort, such as a wearing feeling, a consciousness of being watched, and the like, hearing aids have gradually decrease in size and are equipped with a sound amplification function based on fitted information.

Currently, mobile electronic devices have been developed to be equipped with a variety of functions, such as a photographing function, a navigation function, a payment function, and the like, so that the users may use the corresponding services. Therefore, if users have such a mobile electronic device, they do not need to carry a camera, a navigation system, a credit card or cash, and the like.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a method and apparatus that compensates for a signal in an electronic device by using filter data of hearing aids and allows users to hear the same sound through the electronic device as the hearing aids.

In accordance with an aspect of the present disclosure, a signal compensation method is provided. The signal compensation method includes storing filter data related to a hearing aid in a storage unit, recording a first sound signal, and compensating for the first sound signal, based on the filter data.

In accordance with another aspect of the present disclosure, a signal compensation method is provided. The signal compensation method includes detecting status information about an electronic device, recording a first sound signal, and compensating for the first sound signal, based on filter data related to a hearing aid and the status information.

In accordance with another aspect of the present disclosure, an electronic device is provided. The electronic device includes a storage unit configured to store filter data related to a hearing aid, an audio processor configured to record a first sound signal, and a controller configured to compensate for the first sound signal, based on the filter data.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
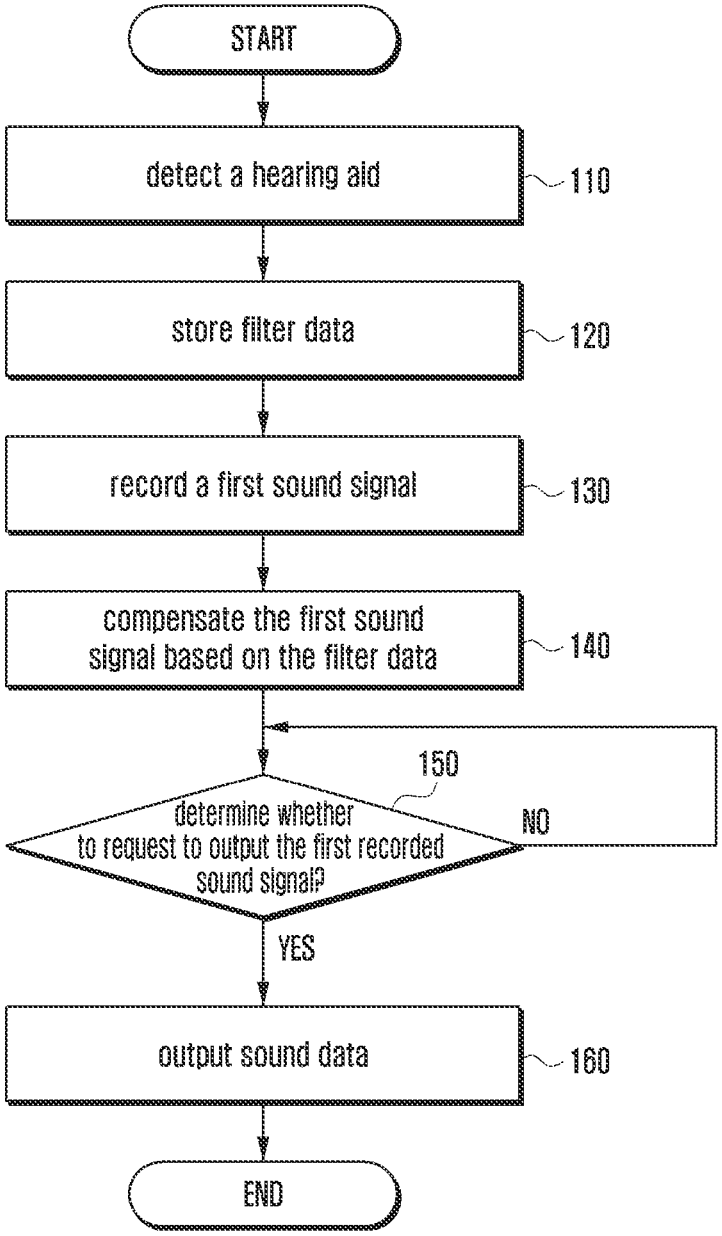
FIG. 1 is a flow chart that describes a method of compensating for a signal according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein may be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

An electronic device according to the present disclosure may be a device including a communication function and a microphone. Examples of the electronic device are a smartphone, a tablet Personal Computer (PC), a mobile phone, a video phone, an e-book reader, a desktop PC, a laptop PC, a netbook computer, a Personal Digital Assistant (PDA), a Portable Multimedia Player (PMP), a digital audio player (e.g., a Moving Picture Experts Group (MPEG-1 or MPEG-2) Audio Layer III (MP3) player), a mobile medical device, a camera, a wearable device, and the like. Examples of the wearable device are a head-mounted-device (HMD) (e.g., electronic eyeglasses), electronic clothing, an electronic bracelet, an electronic necklace, an electronic accessory, a smart watch, and the like.

In addition, an electronic device according to the present disclosure may be smart home appliances including a communication function. Examples of home appliances are a television (TV), a Digital Versatile Disc (DVD) player, an audio system, a refrigerator, an air-conditioner, a cleaning device, an oven, a microwave oven, a washing machine, an air cleaner, a set-top box, a TV box (e.g., Samsung HomeSync™, Apple TV™, or Google TV™), a game console, an electronic dictionary, an electronic key, a camcorder, an electronic album, or the like.

An electronic device according to the present disclosure may be various medical devices (e.g., Magnetic Resonance Angiography (MRA), Magnetic Resonance Imaging (MRI), Computed Tomography (CT), a scanning machine, an ultrasonic wave device, and the like), a navigation device, a Global Positioning System (GPS) receiver, an Event Data Recorder (EDR), a Flight Data Recorder (FDR), a vehicle infotainment device, an electronic equipment for ships (e.g., navigation equipment, gyrocompass, and the like), avionics, a security device, an industrial or home robot, and the like.

An electronic device according to the present disclosure may be furniture or a portion of a building/structure that includes a communication function, an electronic board, an electronic signature receiving device, a projector, various measurement devices (e.g., faucet water, electricity, city gas, electro-magnetic wave), and the like, and a combination thereof. It is obvious to those skilled in the art that the electronic device according to the present disclosure is not limited to the aforementioned devices.

FIG. 1 is a flow chart that describes a method of compensating for a signal according to an embodiment of the present disclosure.

Referring to FIG. 1, an electronic device detects a hearing aid at operation 110. A hearing aid is an electronic apparatus that is worn in or behind the ear and amplifies sound for the wearer. A hearing aid includes a microphone for converting sound to electrical signal, an amplifier for amplifying the electrical signal and a loudspeaker for converting an electrical signal to audible sound. The hearing aid may set a frequency range to be audible for a person who has difficulty in hearing.

The electronic device needs filter data of the hearing aid in order to output the same quality of sound as the hearing aid. The electronic device may receive the filter data from the hearing aid. The electronic device may create filter data by using information transmitted from the hearing aid. The creation of filter data will be described in detail later referring to FIGS. 3A and 3B.

The electronic device stores the filter data in a storage unit at operation 120. The filter data is used to perform the optimization and compensation of sound signals to meet a user's ability to hear. It should be understood that the present disclosure is not limited to operation 120 where the filter data is stored. It should be understood that the optimization and compensation of sound signals are perform by not only the filter data stored in the electronic device in operation 120 but also the status information about the electronic device, sound information that has been stored in the electronic device, and the like.

The electronic device records a first sound signal at operation 130. For example, the electronic device may record a first sound signal input to an audio input unit. The electronic device may also record a first sound signal output from an audio output unit. In general, the electronic device sets compensation parameters according to file formats of system. Therefore, the electronic device may apply the mobile device's default compensation parameters to a first sound signal that is input to or output to from the component.

The electronic device compensates for the first sound signal based on the filter data at operation 140. The electronic device may simultaneously perform both operations 130 and 140. That is, the electronic device may record the first sound signal and simultaneously compensate for the first sound signal. The electronic device has recorded a first sound signal and compensates for the first recorded sound signal. The electronic device creates sound data by compensating for the first sound signal.

The electronic device determines whether the user requests to output the first recorded sound signal at operation 150.

When the electronic device ascertains that the user has requested to output the first recorded sound signal at operation 150, the electronic device outputs the sound data through an audio output unit at operation 160. The electronic device may output the sound data through an application (e.g., an audio record application, a video player application, and the like).

In an embodiment of the present disclosure, the electronic device may provide the sound data to a hearing aid or earphones. The earphones may be equipped with a hearing aid function.

Figure 2A:
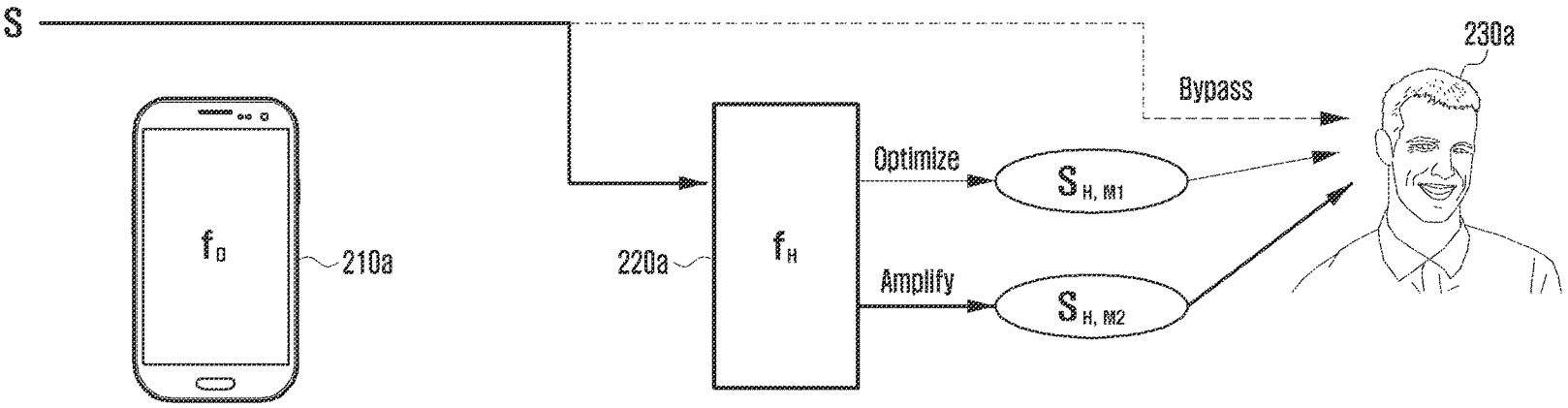
FIGS. 2A and 2B are views that describe a sound difference between a hearing aid and an electronic device according to various embodiments of the present disclosure.
Figure 2B:
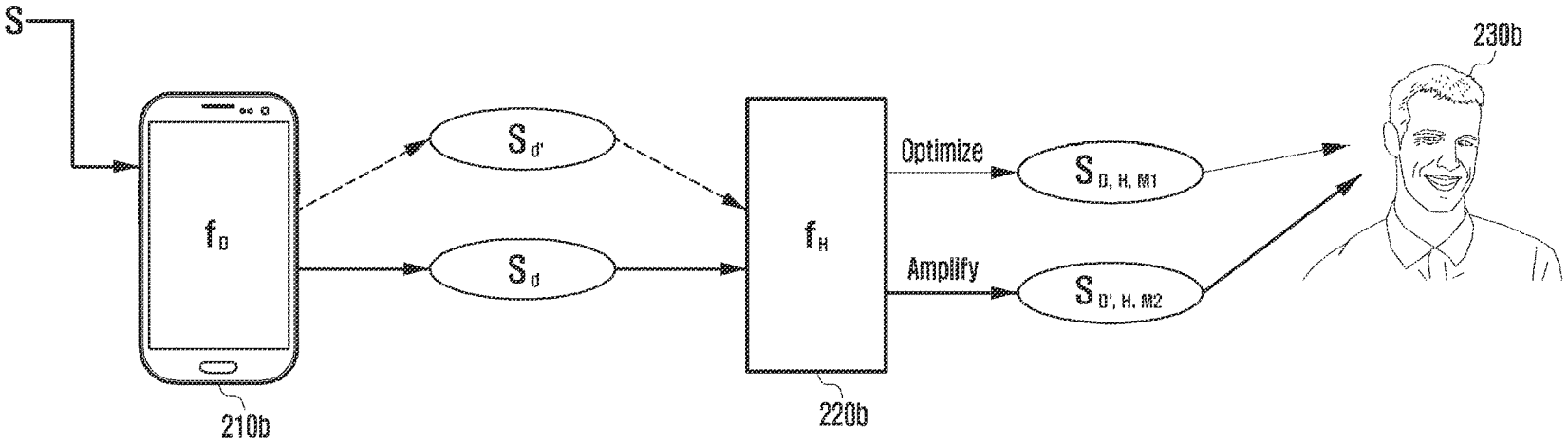

FIGS. 2A and 2B are views that describe a sound difference between a hearing aid and an electronic device according to various embodiments of the present disclosure.

Referring to FIG. 2A, a hearing aid 220*a* receives real sound S through a microphone, optimizes or amplifies the received real sound S, and provides optimized sound $S_{H,\,M1}$ or amplified sound $S_{H,\,M2}$ to the ear of a wearer 230*a*. The optimization system includes units for amplifying and filtering sound. In contrast with an electronic device 210*a*, the hearing aid 220*a* creates filter data used to compensate for signals to meet the wearer's hearing characteristic. The hearing aid 220*a* optimizes real sound S by using the filter data and provides the optimized sound to the wearer 230*a*. The filter data includes optimized values for signal compensation and input of the hearing aid.

Referring to FIG. 2B, the electronic device 210*b* stores real sound S by recording a video or audio, using a photograph screen shot function, and the like, and provides the real sound S to the wearer 230*b* through the hearing aid 220*b*. The electronic device 210*b* records real sound S as a first sound signal by performing a signal process ($f_D$) considering the device characteristics (or the device inherent characteristics), and stores sound data $S_D$ processed from the first sound signal by the characteristics (parameters) of the electronic device 210*b*. When the hearing aid 220*b* receives sound data $S_D$, the hearing aid 220*b* applies filter data to the data and provides the optimized sound $S_{D,H,M1}$ or amplified sound $S_{D,H,M2}$ to the wearer 230*b*.

The electronic device 210*b* provides revised sound data $S_{D'}$ by the filter data. The filter data may be data related to the hearing aid 220*b*. The filter data may be created by using hearing aid-related data. The hearing aid-related data includes filter data of the hearing aid 220*b* or information about sound stored (recorded) through the hearing aid 220*b*. The electronic device 210*b* provides revised sound data $S_{D'}$ that is compensated for by using the filter data. When the hearing aid 220*a* receives the revised sound data $S_{D'}$, the hearing aid 220*a* provides the optimized sound $S_{D',H,M1}$ or amplified sound $S_{D',H,M2}$ to the wearer 230*b*.

Although the electronic device 210*b* and the hearing aid 220*b* record and output the same sound, the optimized sound $S_{D,H,M1}$ or amplified sound $S_{D,H,M2}$ output from the hearing aid 220*b*, created from the signal stored in the electronic device 210*b*, differs in quality from the sound $S_{H,M1}$ or $S_{H,M2}$ that the hearing aid 220*b* provides. Since the electronic device 210*b* processes an audio signal, based on the input form of the microphone (i.e., an audio input unit), the characteristic of the microphone, and the state of the loudspeaker (i.e., an audio output unit), the electronic device 210*b* may not output the same audio signal as the user or wearer 230*b* hears directly.

The sound data $S_D$ needs to have a similar characteristic to that of real sound S transmitted to a hearing aid. The electronic device may store sound data $S_{D'}$ revised by the filter data, which is similar to real sound S transmitted to a hearing aid. When the hearing aid 220*b* receives the sound data $S_{D'}$, the hearing aid 220*b* optimizes sound data $S_{D'}$ and provides optimized sound $S_{D',H,M1}$. The electronic device may store the sound data $S_{D'}$, similar to sound provided by the hearing aid, by using the filter data. When the hearing aid 220*b* receives the sound data $S_{D'}$, the hearing aid 220*b* amplifies the sound data $S_{D'}$ and provides amplified sound $S_{D',H,M2}$.

Figure 3A:
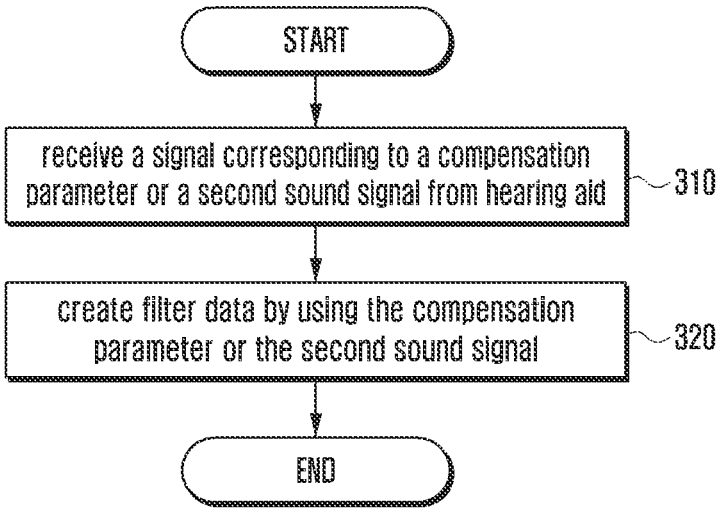
FIGS. 3A and 3B are flow charts that describe method of creating filter data according to various embodiments of the present disclosure.
Figure 3B:
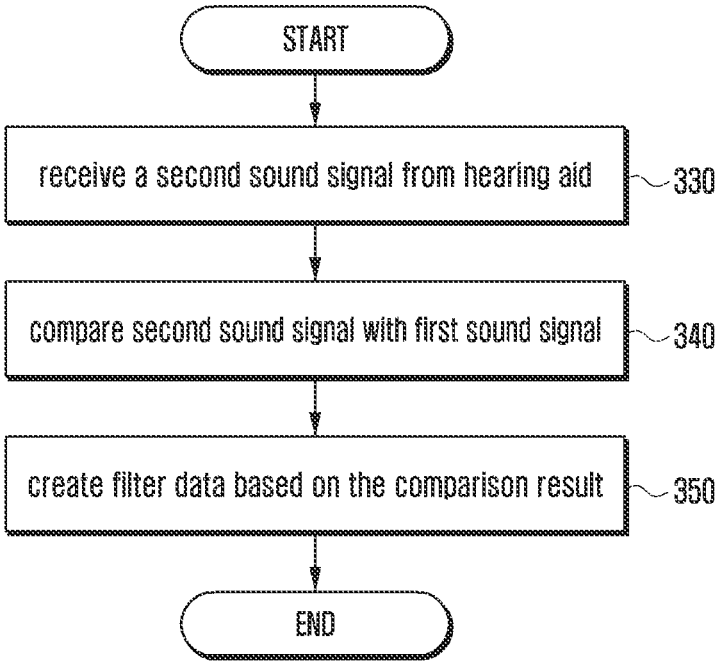

FIGS. 3A and 3B are flow charts that describe method of creating filter data according to various embodiments of the present disclosure.

Referring to FIG. 3A, an electronic device receives a signal corresponding to a compensation parameter or a second sound signal from the hearing aid at operation 310. The compensation parameter refers to an inherent parameter that the hearing aid uses to compensate for sound.

The electronic device creates filter data by using the compensation parameter or the second sound signal at operation 320. The electronic device stores the created filter data in the storage unit.

Referring to FIG. 3B, the electronic device receives a second sound signal from the hearing aid at operation 330. The second sound signal includes the right sound signal and the left sound signal.

The electronic device compares the second received sound signal with the first sound signal at operation 340. The first sound signal may be a signal recorded or received in the electronic device.

The electronic device creates filter data by the comparison result at operation 350. The electronic device may create filter data by the difference between the first sound signal and the second sound signal.

In various embodiments of the present disclosure, the electronic device revises the filter data by using a parameter compensating for the difference between the first sound signal and the second sound signal.

In various embodiments of the present disclosure, the electronic device revises the created filter data by using one or more of the following: a user's characteristic, status information about the electronic device, temperature, humidity, air pressure, weather condition, time, and location. For example, a user's characteristic is used to revise a frequency band or a level of amplification according to a user's hearing ability. The user's characteristic is adjusted in such a way that: the sound signal is amplified in amplitude, large or small; and the frequency band is wide or narrow for a high pitched sound or a low pitched sound. The status information about the electronic device includes a mode of the electronic device or an orientation where the electronic device is arranged. The mode of the electronic device may be in a 'mono' mode or 'stereo' mode. For example, when the electronic device records or outputs (reproduce) a sound signal, the sound signal may be affected according to whether the electronic device runs in a mono or stereo mode or whether the electronic device is placed in portrait or landscape.

The first sound signal recorded in the electronic device may be affected by the surrounding environments. For example, the sound resounds more at night than during the day. The audio parts of the electronic device are easily subjected to humidity, so that the output sound may vary whether the amount of water vapor in the air is high or low. When the electronic device records a first sound signal in the same location as the electronic device has done, the electronic device may employ the same filter data that the electronic device has used for the first sound signal. Therefore, the electronic device may revise the filter data by using the sensor data detected by the sensor unit.

In various embodiments of the present disclosure, the electronic device sorts and stores the filter data, by one or more of the following sensor data: a user's characteristic, status information about the electronic device, temperature, humidity, air pressure, weather condition, time, and location. For example, when the electronic device revises filter data based on the location information (e.g., Nonhyeon-dong in Seoul, an outdoor concert hall, a music hall, and the like), the electronic device stores the filter data by the location information respectively. In that case, when the electronic device happens to output sound data at the same location (place), the electronic device may use the stored filter data.

Figure 4:
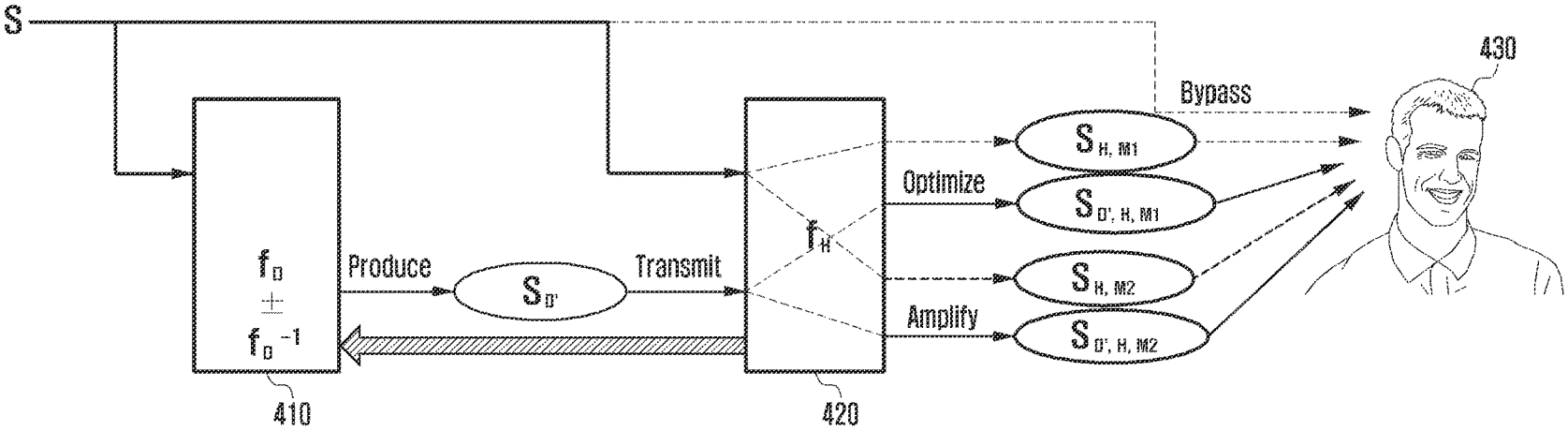
FIG. 4 is a view that describes a method of compensating for a sound signal based on filter data according to an embodiment of the present disclosure.

FIG. 4 is a view that describes a method of compensating for a sound signal based on filter data according to an embodiment of the present disclosure.

Referring to FIG. 4, an electronic device 410 performs a filter signal process ($f_D^{-1}$) by using data related to a hearing aid 420 to perform a signal process ($f_D$) by the device inherent characteristics. The data includes filter data of the hearing aid 220*b* or information about sound stored (recorded) through the hearing aid 220*b*.

The electronic device 410 creates sound data $S_{D'}$ by compensating for real sound S recorded as a first sound signal, by the filter signal process ($f_D^{-1}$). When the hearing aid 420 receives real sound S, the hearing aid 420 applies filter data to the real sound S and provides optimized sound $S_{H,M1}$ to the wearer 430. When the hearing aid 420 receives real sound S, the hearing aid 420 may provide amplified sound $S_{H,M2}$ to the wearer 430. When the hearing aid 420 receives revised sound data $S_{D'}$, revised by filter data of the hearing aid 420, from the electronic device 410, the hearing aid 420 provides the optimized sound $S_{D',H,M1}$ or amplified sound $S_{D',H,M2}$ to the wearer 430.

Therefore, when the electronic device according to various embodiments of the present disclosure outputs a video that the electronic device has taken by using filter data of a hearing aid, the electronic device may provide the same sound data as the user heard at the scene of making the video.

In various embodiments of the present disclosure, the signal compensation method includes storing filter data related to a hearing aid in a storage unit; recording a first sound signal; and compensating for the first sound signal, based on the filter data.

The process of storing filter data includes receiving the filter data from the hearing aid.

The method further includes receiving a signal related to a compensation parameter or a second sound signal from the hearing aid; and creating filter data by using the compensation parameter or the second sound signal.

The method further includes receiving a second sound signal from the hearing aid; comparing the second sound signal with the first sound signal; and creating filter data based on the comparison result.

The process of creating the filter data includes: revising the created filter data by using one or more of the following: a user's characteristic, status information about the electronic device, temperature, humidity, air pressure, weather condition, time, and location.

The process of storing data related to a hearing aid includes: sorting and storing the filter data, by one or more of the following sensor data: a user's characteristic, status information about the electronic device, temperature, humidity, air pressure, weather condition, time, and location.

The process of recording a first sound signal includes recording the first sound signal input to an audio input unit.

The process of compensating for the first sound signal includes creating sound data by compensating for the first sound signal that is being recorded or has been recorded.

The method further includes outputting the sound data to an audio output unit.

Figure 5:
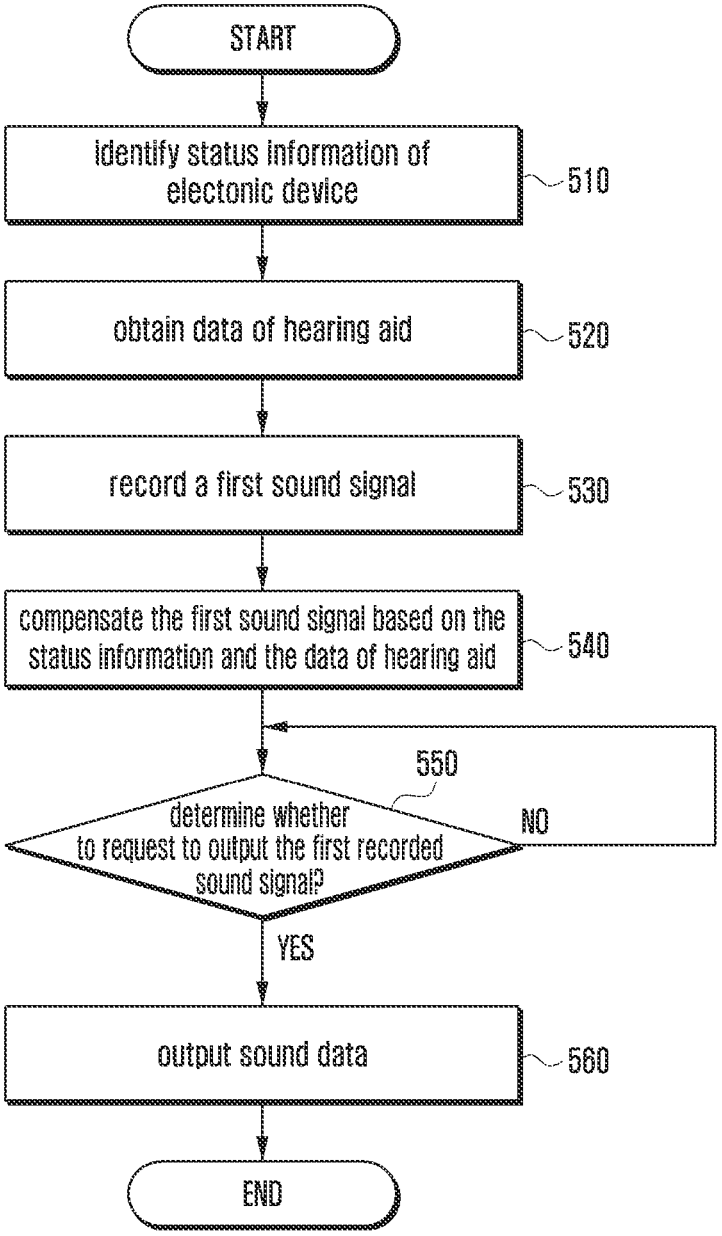
FIG. 5 is a flow chart that describes a method of compensating for a signal according to an embodiment of the present disclosure.

FIG. 5 is a flow chart that describes a method of compensating for a signal according to an embodiment of the present disclosure.

Referring to FIG. 5, an electronic device may identify the status information of the electronic device at operation 510. The status information includes information about a mode where the electronic device runs, information about an orientation where the electronic device is arranged. The mode of the electronic device may be in a 'mono' mode or 'stereo' mode. When the audio processor is set to a 'mono' mode, the sound signal is input or output through a single signal line. When the audio processor is set to a 'stereo' mode, the sound signal is input or output through dual lines or two or more lines. Therefore, the electronic device records or outputs (reproduces) sound signals in different formats according to the modes set for the audio processor.

The orientation information indicates whether the electronic device is arranged in portrait or landscape or in an oblique angle (e.g., 45°). The orientation of the electronic device affects the direction of inputting or outputting sound signals to or from the audio processor when the electronic device performs a sound signal recording function or a sound signal outputting function.

Therefore, the electronic device detects the status information and the right and left information. The right and left information refers to information about the right and left of the audio processor when the electronic device records or outputs sound signals.

In an embodiment of the present disclosure, the electronic device obtains one or more of the following sensor data: a user's characteristic, temperature, humidity, air pressure, weather condition, time, and location, and detects the right and left information by using the obtained sensor data and the status information.

The electronic device obtains data of a hearing aid at operation 520. The data of a hearing aid is used to optimize and compensate a sound signal to meet the wearer's hearing characteristic. To this end, the electronic device may receive filter data of the hearing aid or may use information transmitted from the hearing aid (e.g., a second sound signal). The electronic device creates filter data by using the data of a hearing aid. The electronic device receives a signal corresponding to a compensation parameter or a second sound signal from the hearing aid and creates filter data by using the compensation parameter and the second sound signal. The electronic device receives a second sound signal from the hearing aid, compares the second received sound signal with the first sound signal that has been recorded, and creates filter data based on the comparison result.

The electronic device records or outputs sound signals, depending on a user's characteristic, the status information, and the surrounding environments. Therefore, the electronic device revises the created filter data by using one or more of the following: a user's characteristic, status information about the electronic device, temperature, humidity, air pressure, weather condition, time, and location.

In various embodiments of the present disclosure, the electronic device sorts and stores the filter data, by one or more of the following sensor data: a user's characteristic, status information about the electronic device, temperature, humidity, air pressure, weather condition, time, and location. For example, when the electronic device revises filter data based on the location information (e.g., Nonhyeon-dong in Seoul, an outdoor concert hall, a music hall, and the like), the electronic device stores the filter data by the location information respectively. In that case, when the electronic device happens to output sound data at the same location (place), the electronic device may use the stored filter data.

The electronic device records a first sound signal at operation 530.

The electronic device compensates for the first sound signal based on the status information and the data of hearing aid at operation 540. The electronic device creates sound data by compensating for the first sound signal.

The electronic device determines whether the user has made a request to output the first recorded sound signal at operation 550.

When the electronic device ascertains that the user has made a request to output the first recorded sound signal at operation 550, the electronic device outputs the sound data through the audio output unit at operation 560.

FIGS. 6A, 6B, 6C, 6D, and 6E are views that describe a method of detecting state information about an electronic device according to various embodiments of the present disclosure.

Figure 6A:
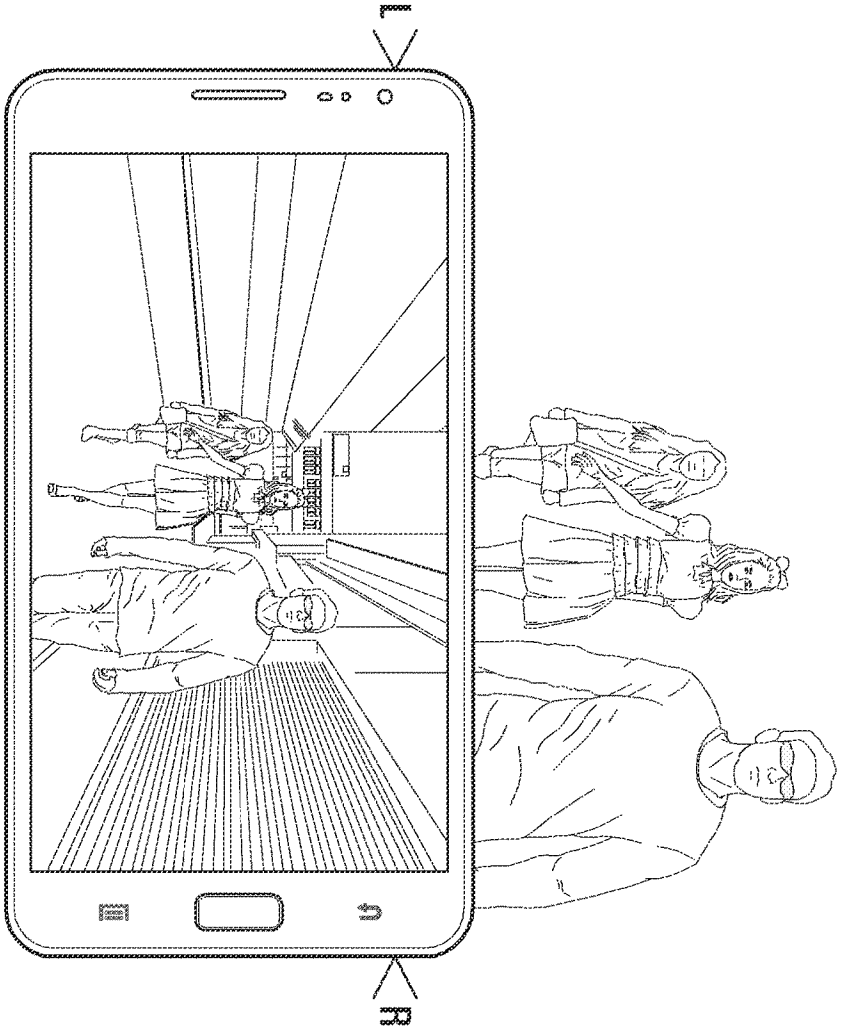
FIGS. 6A, 6B, 6C, 6D and 6E are views that describe a method of detecting state information about an electronic device according to various embodiments of the present disclosure.

Referring to FIG. 6A, the electronic device takes a video in a landscape mode. For example, when the electronic device includes a number of microphones, an optimal one of them may be selected. In that case, the electronic device records a first sound signal with the video in stereo mode. The electronic device records the right sound signal through a first microphone (R) located at the right and the left sound signal through a second microphone (L) located at the left, according to the orientation. The electronic device matches the left and right sound signals with the left filter data and right filter data of the hearing aid, respectively, and compensates for the left and right sound signals.

Figure 6B:
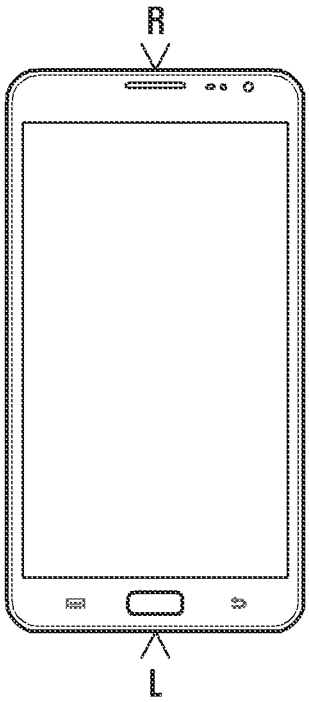

Referring to FIG. 6B, the electronic device takes a video in a portrait mode. In that case, the electronic device records the right sound signal through a first microphone (R) located at the top and the left sound signal through a second microphone (L) located at the bottom.

Figure 6C:
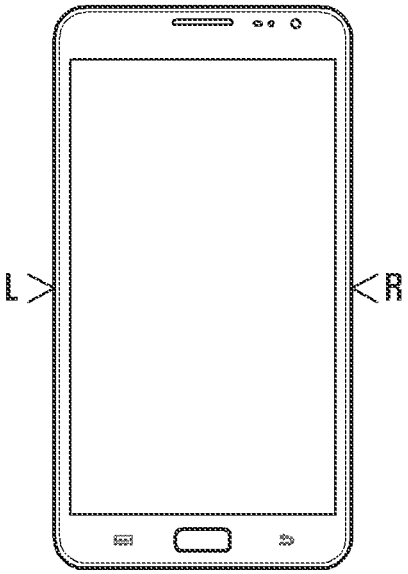

Referring to FIG. 6C, the electronic device takes a video in a portrait mode. In that case, the electronic device records the right sound signal through a first microphone (R) located at the right and the left sound signal through a second microphone (L) located at the left.

Figure 6D:
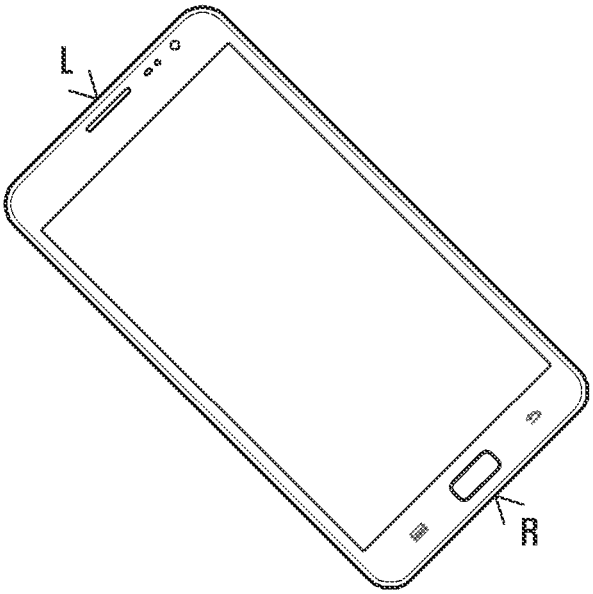

Referring to FIG. 6D, the electronic device takes a video in the portrait mode in an oblique state where the top is tilted to the left at over 45° with respect to the vertical axis. In that case, the electronic device records the left sound signal through a second microphone (L) located at the top and the right sound signal through a first microphone (R) located at the bottom.

Figure 6E:
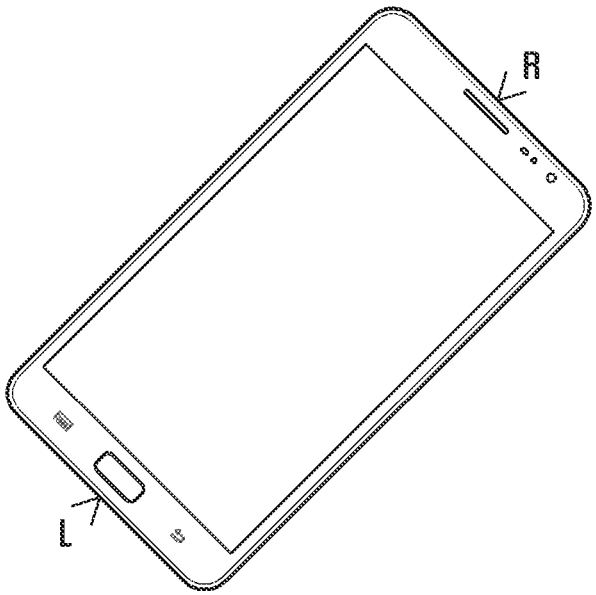

Referring to FIG. 6E, the electronic device takes a video in the portrait mode in an oblique state where the top is tilted to the right at over 45° with respect to the vertical axis. In that case, the electronic device records the right sound signal through a first microphone (R) located at the top and the left sound signal through a second microphone (R) located at the bottom.

Therefore, the electronic device determines the right and left of the audio processor, based on the mode and/or the orientation.

In various embodiments of the present disclosure, the signal compensation method includes detecting status information about an electronic device; recording a first sound signal; and compensating for the first sound signal, based on filter data related to a hearing aid and the status information.

When the status information includes a mode of the electronic device or an orientation where the electronic device is arranged, the process of detecting status information includes detecting the left and right of the electronic device, based on the status information. The mode of the electronic device may be in a 'mono' mode or 'stereo' mode.

The process of detecting status information includes obtaining one or more of the following sensor data: a user's characteristic, temperature, humidity, air pressure, weather condition, time, and location.

The process of compensating for the first sound signal includes receiving a signal corresponding to a compensation parameter from the hearing aid or creating the filter data by using information transmitted from the hearing aid.

Figure 7:
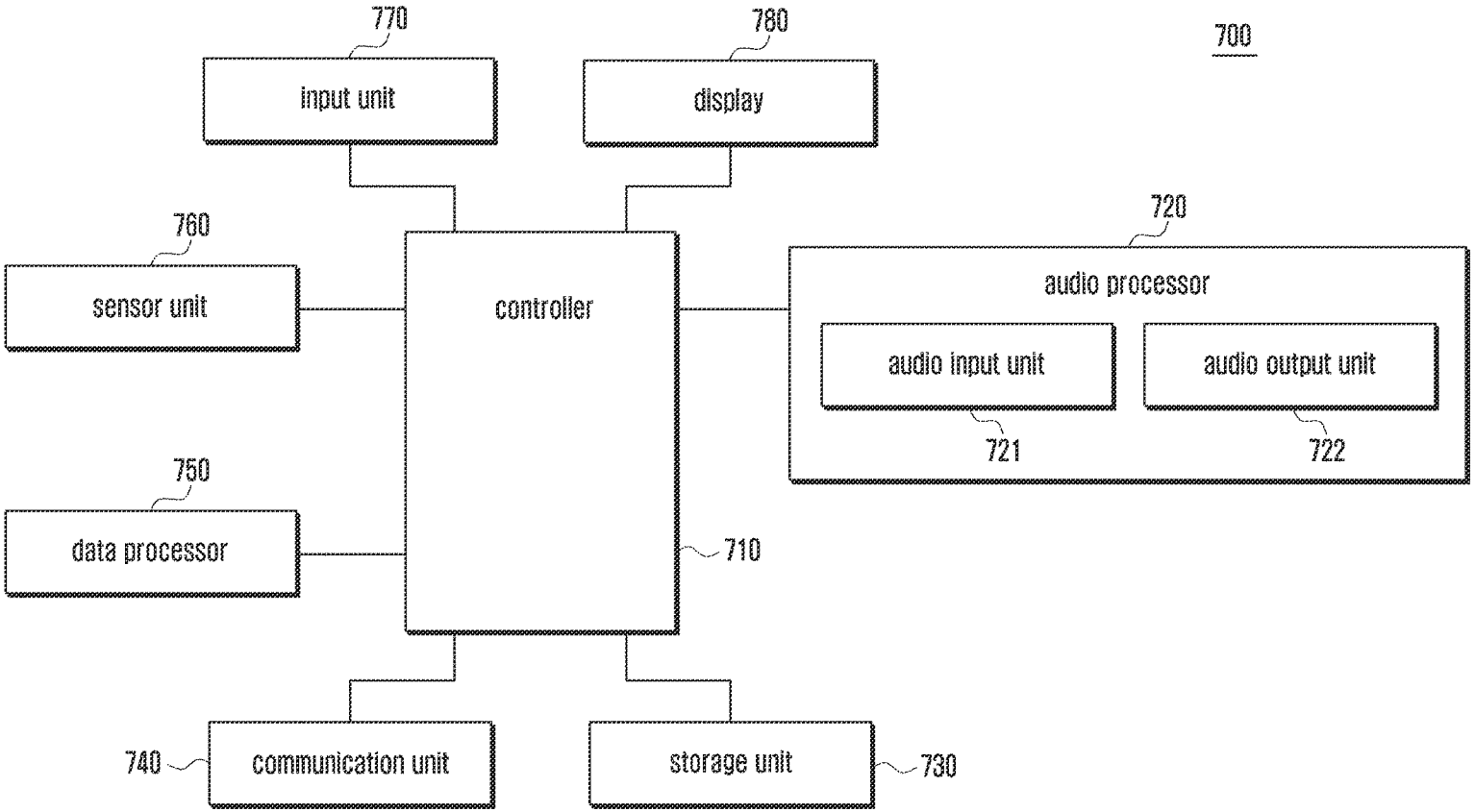
FIG. 7 is a schematic block diagram of an electronic device according to an embodiment of the present disclosure.

FIG. 7 is a schematic block diagram of an electronic device according to an embodiment of the present disclosure.

Referring to FIG. 7, an electronic device 700 includes a controller 710, an audio processor 720, a storage unit 730, a communication unit 740, a data processor 750, a sensor unit 760, an input unit 770 and a display 780.

The storage unit 730 stores filter data related to a hearing aid. The storage unit 730 stores software required for the operations of the electronic device 700. The storage unit 730 stores data received by or created in the electronic device 700. The storage unit 730 may be implemented with various types of digital storage media that the controller 710 may read/store data from/in. The storage unit 730 stores one or more application programs to perform corresponding functions.

The storage unit 730 may also be implemented with disks, random access memory (RAM), read-only memory (ROM), flash memory, and the like, as a secondary memory unit of the controller 710. The storage unit 730 stores data (e.g., contacts) created in the electronic device 700. The storage unit 730 also stores data (e.g., messages, video files, and the like) received from the outside through the communication unit 740. The storage unit 730 stores size information about images (e.g., a keypad, a video, a message, and the like) and the display area information about the images. When a display screen is defined by a unit of pixel, the size information is expressed by, for example, 'x*y,' where x and y are integers. 'x' denotes the x-th pixel in the X-axis and 'y' denotes the y-th pixel in the Y-axis. The display area information includes for four points of coordinates, (x1, y1), (x2, y2), (x3, y3), and (x4, y4). The display area information may be one point of coordinates.

The storage unit 730 stores setting values, for example, an option as to whether to automatically adjust a level of screen brightness, an option as to whether to use Bluetooth, an option as to whether to use a pop-up function, an option as to whether to user a location change table, and the like. The storage unit 730 stores a booting program, an operating system (OS), and applications. OS performs an interface function between hardware and applications, and between applications, and manages resources in the electronic device, such as central processing unit (CPU), graphics processing unit (GPU), main memory devices, auxiliary memory devices, and the like Operating system controls hardware, runs applications, schedules tasks, controls operations in CPU and GPU, performs the storage function of data and files, and the like. Applications are divided into an embedded application and a 3rd party application. Examples of the embedded application are web browsers, email applications, instant messengers, and the like. Examples of the 3rd party application are applications that the electronic device 700 downloads from web markets and installed in the electronic device 700. When the electronic device 700 is turned on, the booting program is loaded on a main memory (e.g., RAM) of the controller 710. The booting program loads OS on the main memory. OS loads applications (e.g., a video player, on the main memory).

The storage unit 730 stores speech-to-text (STT) software for converting voice data into text. The storage unit 730 stores an artificial intelligence program for analyzing voice data and detecting speaker's intent. An artificial intelligence program includes a natural language processing engine for recognizing context from voice data, an engine for reasoning a user's intent from the recognized context, an engine for making a conversation with a user based on the recognized context, and the like.

The filter data is transmitted from the hearing aid to the electronic device 700. The filter data is also created as the data processor 750 receives information transmitted from the hearing aid and processes the information.

The communication unit 740 receives a signal related to a compensation parameter and a second sound signal from the hearing aid. The communication unit 740 makes a voice/video call or performs data communication with external devices through a network, under the control of the controller 710. The communication unit 740 includes a transmitter for up-converting the frequency of signals to be transmitted and amplifying power of the signals and a receiver for low-noise amplifying received signals and down-converting the frequency of the received signals. The communication unit 740 includes a mobile communication module (e.g., a $3^{rd}$-Generation (3G) mobile communication module, 3.5G, 4G, and the like), a digital broadcasting module (e.g., a digital multimedia broadcasting (DMB) module), a short-range communication module (e.g., a wireless fidelity (Wi-Fi) module, a Bluetooth (BT) module, and a Near Field Communication (NFC) module), and the like.

The data processor 750 creates filter data by using the compensation parameter and the second sound signal. The data processor 750 may also create filter data by comparing the received second sound signal with the first sound signal. In other embodiments, the data processor 750 revises the created filter data by using one or more of the following: a user's characteristics, status information about the electronic device, temperature, humidity, air pressure, weather condition, time, and location.

The sensor unit 760 includes one or more of the following sensors: a gyro sensor, an acceleration sensor, a humidity sensor, a proximity sensor, an infrared sensor, an illuminance sensor, an image sensor, and an earth magnetic field sensor. The sensor unit 760 outputs status information, temperature information, humidity information, air pressure information, weather condition information, time information and location information by using the data obtained by the sensors.

The audio processor 720 records a first sound signal in the storage unit 730. The audio processor 720 includes an audio input unit 721 and an audio output unit 722. The audio processor 720 records a first sound signal that is input to the audio input unit 721 or output from the audio output unit 722. The audio input unit 721 may be a microphone and the audio output unit 722 may be a loudspeaker. The audio processor 720 performs a speech recognizing, speech recording, digital data recording, inputting and inputting audio signals for a call (e.g., voice data), and the like, through a loudspeaker and a microphone. The audio processor 720 converts digital audio signals, from the controller 710, into analog signals, amplifies the analog signals, and outputs them through the speaker. The audio processor 720 converts an analog audio signal (a first sound signal), received by the microphone, into a digital signal, and transfers the digital signal to the controller 710. The speaker converts an audio signal (sound data) into a sound wave and outputs the audio signal. The microphone converts a voice or a sound wave from a sound source into an audio electrical signal.

The controller 710 compensates for the first sound signal based on the filter data. The controller 710 controls the entire operation of the electronic device 700 and signal flows among the components in the electronic device 700. The controller 710 also performs a data processing function. The controller 710 controls the power supply from the battery to the components. The controller 710 includes a CPU and GPU. A CPU is a main control unit within a system that performs arithmetic operations, compares data, analyzes and rungs the instructions, and the like A GPU is a graphic control unit specialized to process graphic data, instead of a CPU. GPUs perform operations and comparisons for graphic-related data, analyze and run the instructions, and the like. A CPU and GPU are each integrated into a single package where two or more independent cores (e.g., quad-core) are formed in a single integrated chip (IC). A CPU and GPU are integrated into a single chip, i.e., a System on Chip (SoC). A CPU and GPU may also be packaged in multi-layer. The configuration including a CPU and GPU is called an application processor (AP).

The controller 710 creates sound data by compensating for the first sound signal that is being recorded or has been recorded. The controller 710 detects the mode of the electronic device 700 or the orientation where the electronic device 700 is arranged and detects the right and left information. The mode of the electronic device may be in a 'mono' mode or 'stereo' mode. The controller 710 compensates for the first sound signal based on the detected right and left information and the filter data.

The input unit 770 includes a number of keys for inputting numbers and characters and setting a variety of functions. Examples of the keys are a menu key, a screen turning on/off key, a power on/off key, a volume key, and the like. The input unit 770 creates signals corresponding to key events for setting user's options and for controlling functions of the electronic device 700 and transfers them to the controller 710. Examples of the key events are a power on/off event, a volume adjusting event, a screen on/off event, a shutter event, and the like. The controller 710 controls the components in response to the key events. The keys of the input unit 770 are called hard keys. In contrast with this, keys displayed on the display 780 are called soft keys or virtual keys.

The display 780 displays one or more images on the screen under the control of the controller 710. When the controller 710 processes (or decodes) data into an image data to be displayed on the screen and stores the image data in the buffer, the display 780 converts the stored image data into analog screen data and displays the image on the screen. The display 780 may be implemented with a Liquid Crystal Display (LCD), Organic Light Emitting Diodes (OLEDs), Active Matrix OLEDs (AMOLEDs), flexible displays, or the like.

In various embodiments of the present disclosure, the electronic device includes a storage unit for storing filter data related to a hearing aid; an audio processor for recording a first sound signal; and a controller for compensating for the first sound signal, based on the filter data.

The storage unit stores the filter data transmitted from the hearing aid.

The electronic device further includes a communication unit for receiving a signal related to a compensation parameter or a second sound signal from the hearing aid; and a data processor for creating filter data by using the compensation parameter or the second sound signal.

The electronic device further includes a communication unit for receiving a second sound signal from the hearing aid, and a data processor for comparing the second sound signal with the first sound signal and creating filter data based on the comparison result.

The data processor revises the filter data by using one or more of the following: a user's characteristics, status information about the electronic device, temperature, humidity, air pressure, weather condition, time, and location.

The audio processor includes an audio input unit. The audio processor records the first sound signal through the audio input unit.

The controller creates sound data by compensating for the first sound signal that is being recorded or has been recorded.

The controller detects right and left information by detecting a mode of the electronic device, an orientation where the electronic device is arranged, and a mode state. The mode of the electronic device may be in a 'mono' mode or 'stereo' mode.

The controller compensates for the first sound signal, based on the filter data, by using one or more of the following: a user's characteristics, temperature, humidity, air pressure, weather condition, time, and location.

The controller sorts and stores the filter data, by one or more of the following sensor data: a user's characteristics, status information about the electronic device, temperature, humidity, air pressure, weather condition, time, and location.

As described above, the electronic device according to various embodiments of the present disclosure may provide similar data as hearing aids.

The electronic device according to various embodiments of the present disclosure may compensate for sound signals to meet the surrounding environments, besides the filter data of hearing aids, thereby outputting sounds so that users hear them directly with their ears.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A signal compensation method comprising:

receiving, by an electronic device, a second sound signal that is recorded by a hearing aid;

recording, by the electronic device, a third sound signal;

comparing, by the electronic device, the second sound signal with the third sound signal;

creating, by the electronic device, filter data based on the comparison result;

determining, by the electronic device, orientation information in which an audio input unit and an audio output unit are located in the electronic device based on identifying an orientation where the electronic device is arranged;

revising, by the electronic device, the created filter data based on the orientation information;

recording, by the electronic device, a first sound signal using the audio input unit; and compensating, by the electronic device, for the first sound signal, based on the revised filter data.

2. The method of claim 1, wherein the storing of the filter data further comprises:

receiving a signal related to a compensation parameter from the hearing aid; and creating the filter data based on the compensation parameter.

3. The method of claim 2, wherein the creating of the filter data comprises:

revising the created filter data based on at least one of a user 's characteristic, temperature, humidity, air pressure, weather condition, time, or location.

4. The method of claim 1, further comprising:

sorting and storing the filter data, based on sensor data comprising at least one of a user 's characteristic, the orientation information, temperature, humidity, air pressure, weather condition, time, or location.

5. The method of claim 1, wherein the compensating for the first sound signal comprises:

creating sound data by compensating the first sound signal that is being recorded or has been recorded.

6. The method of claim 1, wherein the determining, by the electronic device, orientation information comprises:

identifying a mode of the electronic device; and determining the orientation information based on the identifying of the mode of the electronic device.

7. An electronic device comprising:

an audio input unit;

an audio output unit;

a memory; and at least one processor configured to:

receive a second sound signal that is recorded by a hearing aid, record, by the electronic device, a third sound signal, compare the second sound signal with the third sound signal, create filter data based on the comparison result, determine orientation information in which the audio input unit and the audio output unit are located in the electronic device based on identifying an orientation where the electronic device is arranged, revise the created filter data based on the orientation information, record a first sound signal using the audio input unit, and compensate for the first sound signal based on the revised filter data.

8. The electronic device of claim 7, wherein the at least one processor is further configured to store the filter data transmitted from the hearing aid.

9. The electronic device of claim 7, wherein the at least one processor is further configured to:

receive a signal related to a compensation parameter, and create the filter data based on the compensation parameter.

10. The electronic device of claim 7, wherein the at least one processor is further configured to revise the filter data based on at least one of a user 's characteristic, temperature, humidity, air pressure, weather condition, time, or location.

11. The electronic device of claim 7, wherein the at least one processor is further configured to create sound data by compensating for the first sound signal that is being recorded or has been recorded.

12. The electronic device of claim 11, wherein the at least one processor is further configured to sort and to store the filter data, based on sensor data comprising at least one of a user 's characteristic, the orientation information, temperature, humidity, air pressure, weather condition, time, or location.

13. The electronic device of claim 11, wherein the at least one processor is further configured to:

determine if the electronic device is in a stereo mode, and compensate, upon determining that the electronic device is in the stereo mode, the first sound signal based on the orientation information and the filter data.

* * * * *